US008839799B2

(12) United States Patent
Conner et al.

(10) Patent No.: US 8,839,799 B2
(45) Date of Patent: Sep. 23, 2014

(54) SEGMENTED SMOKING ARTICLE WITH STITCH-BONDED SUBSTRATE

(75) Inventors: Billy Tyrone Conner, Clemmons, NC (US); Andries Don Sebastian, Clemmons, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 1175 days.

(21) Appl. No.: 12/775,130

(22) Filed: May 6, 2010

(65) Prior Publication Data

US 2011/0271971 A1 Nov. 10, 2011

(51) Int. Cl.

| | |
|---|---|
| ***A24F 13/04*** | (2006.01) |
| ***A24F 47/00*** | (2006.01) |
| ***A24B 15/16*** | (2006.01) |

(52) U.S. Cl.

CPC ..... *A24F 47/006* (2013.01); *A24B 15/165* (2013.01)

USPC ..... 131/194

(58) Field of Classification Search

CPC ..... A24F 47/006

USPC ..... 65/194; 131/194; 128/202.21

See application file for complete search history.

(56) References Cited

U.S. PATENT DOCUMENTS

| | | | |
|---|---|---|---|
| 2,976,190 | A | 3/1961 | Meyer |
| 3,308,600 | A | 3/1967 | Erdmann et al. |
| 3,586,005 | A | 6/1971 | Lippman, Jr. et al. |
| 3,709,706 | A | 1/1973 | Sowman |
| 3,840,024 | A | 10/1974 | Nicholl |
| 4,280,187 | A | 7/1981 | Reuland et al. |
| 4,281,670 | A | 8/1981 | Heitmann et al. |
| 4,572,216 | A | 2/1986 | Josuttis et al. |
| 4,714,082 | A | 12/1987 | Banerjee et al. |
| 4,756,318 | A | 7/1988 | Clearman et al. |
| 4,807,809 | A | 2/1989 | Pryor et al. |

(Continued)

FOREIGN PATENT DOCUMENTS

| | | |
|---|---|---|
| EP | 0 399 252 A2 | 11/1990 |
| EP | 0 532 194 A1 | 3/1993 |

(Continued)

OTHER PUBLICATIONS

U.S. Appl. No. 12/546,107, filed Aug. 24, 2009, Sebastian et al.

(Continued)

*Primary Examiner* — Richard Crispino
*Assistant Examiner* — Yana B Krinker
(74) *Attorney, Agent, or Firm* — Brinks Gilson & Lione

(57) ABSTRACT

A cigarette includes lighting and mouth ends. It may include a smokable segment disposed at the lighting end. It also includes a mouth-end segment; an aerosol-generation system disposed between the lighting and mouth ends, which includes (i) a heat-generation segment adjacent the smokable segment, including a heat source configured to be activated by combustion of a smokable material and an insulation layer of a non-glass material that is woven, knit, or both, and (ii) an aerosol-generating segment with aerosol-forming material disposed between, but physically separate from, each of the heat generation segment and the mouth end; a piece of outer wrapping material that provides an overwrap around at least a portion of the aerosol-generating segment, the heat-generation segment, and at least a portion of the smokable segment; those segments being connected together by the overwrap to provide a cigarette rod; that is connected to the cigarette rod using tipping material.

20 Claims, 3 Drawing Sheets

(56) References Cited

U.S. PATENT DOCUMENTS

| | | | | |
|---|---|---|---|---|
| 4,850,301 | A | 7/1989 | Greene, Jr. et al. | |
| 4,881,556 | A | 11/1989 | Clearman et al. | |
| 4,893,637 | A | 1/1990 | Hancock et al. | |
| 4,922,901 | A | 5/1990 | Brooks et al. | |
| 4,938,238 | A | 7/1990 | Barnes et al. | |
| 4,989,619 | A | 2/1991 | Clearman et al. | |
| 5,020,548 | A | 6/1991 | Farrier et al. | |
| 5,025,814 | A | 6/1991 | Raker | |
| 5,027,836 | A | 7/1991 | Shannon et al. | |
| 5,027,837 | A | 7/1991 | Clearman et al. | |
| 5,040,551 | A | 8/1991 | Schlatter et al. | |
| 5,042,509 | A | 8/1991 | Banerjee et al. | |
| 5,065,776 | A | 11/1991 | Lawson et al. | |
| 5,067,499 | A | 11/1991 | Banerjee et al. | |
| 5,076,297 | A | 12/1991 | Farrier et al. | |
| 5,099,861 | A | 3/1992 | Clearman et al. | |
| 5,105,831 | A | 4/1992 | Banerjee et al. | |
| 5,105,837 | A | 4/1992 | Barnes et al. | |
| 5,105,838 | A | 4/1992 | White et al. | |
| 5,115,820 | A | 5/1992 | Hauser et al. | |
| 5,129,409 | A | 7/1992 | White et al. | |
| 5,137,034 | A | 8/1992 | Perfetti et al. | |
| 5,148,821 | A | 9/1992 | Best et al. | |
| 5,156,170 | A | 10/1992 | Clearman et al. | |
| 5,178,167 | A | 1/1993 | Riggs et al. | |
| 5,183,062 | A | 2/1993 | Clearman et al. | |
| 5,203,355 | A * | 4/1993 | Clearman et al. | 131/359 |
| 5,211,684 | A | 5/1993 | Shannon et al. | |
| 5,246,017 | A | 9/1993 | Saintsing et al. | |
| 5,247,947 | A | 9/1993 | Clearman et al. | |
| 5,285,798 | A | 2/1994 | Banerjee et al. | |
| 5,303,720 | A | 4/1994 | Banerjee et al. | |
| 5,345,955 | A | 9/1994 | Clearman et al. | |
| 5,396,911 | A | 3/1995 | Casey, III et al. | |
| 5,415,186 | A | 5/1995 | Casey, III et al. | |
| 5,469,871 | A | 11/1995 | Barnes et al. | |
| 5,546,965 | A | 8/1996 | White | |
| 5,551,451 | A | 9/1996 | Riggs et al. | |
| 5,560,376 | A | 10/1996 | Meiring et al. | |
| 5,588,446 | A | 12/1996 | Clearman | |
| 5,622,190 | A | 4/1997 | Arterbery et al. | |
| 5,706,834 | A | 1/1998 | Meiring et al. | |
| 5,720,320 | A | 2/1998 | Evans | |
| 5,724,997 | A | 3/1998 | Smith et al. | |
| 5,727,571 | A | 3/1998 | Meiring et al. | |
| 5,791,384 | A | 8/1998 | Evans | |
| 5,819,751 | A | 10/1998 | Barnes et al. | |
| 5,902,431 | A | 5/1999 | Wilkinson et al. | |
| 5,944,025 | A | 8/1999 | Cook et al. | |
| 6,229,115 | B1 | 5/2001 | Voss et al. | |
| 6,849,085 | B2 | 2/2005 | Marton | |
| 7,290,549 | B2 | 11/2007 | Banerjee et al. | |
| 7,293,593 | B2 | 11/2007 | Schiebout | |
| 7,296,578 | B2 | 11/2007 | Read, Jr. | |
| 7,434,585 | B2 | 10/2008 | Holmes | |
| 7,479,098 | B2 | 1/2009 | Thomas et al. | |
| 7,503,330 | B2 | 3/2009 | Borschke et al. | |
| 7,647,932 | B2 | 1/2010 | Cantrell et al. | |
| 7,740,019 | B2 | 6/2010 | Nelson et al. | |
| 7,793,665 | B2 | 9/2010 | Dube et al. | |
| 7,836,897 | B2 | 11/2010 | Borschke et al. | |
| 7,972,254 | B2 | 7/2011 | Stokes et al. | |
| 2002/0119873 | A1 | 8/2002 | Heitmann | |
| 2004/0025894 | A1 * | 2/2004 | Beven et al. | 131/360 |
| 2004/0031495 | A1 | 2/2004 | Steinberg | |
| 2004/0173229 | A1 | 9/2004 | Crooks et al. | |
| 2005/0066986 | A1 | 3/2005 | Nestor et al. | |
| 2005/0274390 | A1 | 12/2005 | Banerjee et al. | |
| 2006/0169295 | A1 | 8/2006 | Draghetti | |
| 2006/0201524 | A1 | 9/2006 | Zhang et al. | |
| 2006/0231113 | A1 | 10/2006 | Newbery et al. | |
| 2006/0272663 | A1 | 12/2006 | Dube et al. | |
| 2007/0023056 | A1 * | 2/2007 | Cantrell et al. | 131/194 |
| 2007/0181141 | A1 | 8/2007 | Xue et al. | |
| 2007/0186945 | A1 | 8/2007 | Olegario et al. | |
| 2007/0215167 | A1 | 9/2007 | Llewellyn Crooks et al. | |
| 2007/0215168 | A1 | 9/2007 | Banerjee et al. | |
| 2008/0029118 | A1 | 2/2008 | Nelson et al. | |
| 2008/0092912 | A1 | 4/2008 | Robinson et al. | |
| 2008/0142028 | A1 | 6/2008 | Fagg | |
| 2008/0233294 | A1 | 9/2008 | Lobovsky et al. | |
| 2008/0302373 | A1 | 12/2008 | Stokes et al. | |
| 2009/0044818 | A1 | 2/2009 | Takeuchi et al. | |
| 2009/0090372 | A1 | 4/2009 | Thomas et al. | |
| 2009/0090373 | A1 | 4/2009 | Borschke et al. | |
| 2009/0194118 | A1 | 8/2009 | Ademe et al. | |
| 2009/0288667 | A1 | 11/2009 | Andresen et al. | |
| 2009/0288672 | A1 | 11/2009 | Hutchens | |
| 2010/0065075 | A1 | 3/2010 | Banerjee et al. | |
| 2010/0186757 | A1 | 7/2010 | Crooks et al. | |
| 2010/0200006 | A1 | 8/2010 | Robinson et al. | |
| 2011/0180082 | A1 | 7/2011 | Banerjee et al. | |
| 2011/0271972 | A1 | 11/2011 | Thomas et al. | |
| 2012/0042885 | A1 | 2/2012 | Stone et al. | |
| 2012/0067360 | A1 | 3/2012 | Conner et al. | |

FOREIGN PATENT DOCUMENTS

| | | | |
|---|---|---|---|
| EP | 1 226 765 | A2 | 7/2002 |
| EP | 1 559 332 | A1 | 8/2005 |
| WO | WO 2008/015441 | A1 | 2/2008 |
| WO | WO 2009/112257 | A1 | 9/2009 |
| WO | WO 2009/132828 | A1 | 11/2009 |
| WO | WO 2011/028372 | A1 | 3/2011 |
| WO | WO 2011/139730 | A1 | 11/2011 |

OTHER PUBLICATIONS

International Search Report for International Application No. PCT/US2010/044989, dated Jan. 21, 2011, 2 pages.

Written Opinion of the International Searching Authority for International Application No. PCT/US2010/044989, dated Jan. 21, 2011, 6 pages.

International Search Report for International Application No. PCT/US2011/034040, dated Oct. 19, 2011, 3 pages.

U.S. Appl. No. 11/377,630.

U.S. Appl. No. 12/546,107.

U.S. Appl. No. 12/688,598.

U.S. Appl. No. 12/775,278.

U.S. Appl. No. 12/859,494.

U.S. Appl. No. 13/236,962.

US 5,119,837, 06/1992, Banerjee et al. (withdrawn)

* cited by examiner

SEGMENTED SMOKING ARTICLE WITH STITCH-BONDED SUBSTRATE

TECHNICAL FIELD

The present invention relates to products made or derived from tobacco, or that otherwise incorporate tobacco, and are intended for human consumption. The present application relates particularly to components and configurations of segmented-type smoking articles.

BACKGROUND

Popular smoking articles, such as cigarettes, have a substantially cylindrical rod-shaped structure and include a charge, roll or column of smokable material, such as shredded tobacco (e.g., in cut filler form), surrounded by a paper wrapper, thereby forming a so-called "smokable rod", "tobacco rod" or "cigarette rod." Normally, a cigarette has a cylindrical filter element aligned in an end-to-end relationship with the tobacco rod. Preferably, a filter element comprises plasticized cellulose acetate tow circumscribed by a paper material known as "plug wrap." Preferably, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth in Tobacco Production, Chemistry and Technology, Davis et al. (Eds.) (1999) and U.S. Pat. No. 7,503,330 to Borschke et al, which is incorporated herein by reference. A cigarette is employed by a smoker by lighting one end thereof and burning the tobacco rod. The smoker then receives mainstream smoke into his/her mouth by drawing on the opposite end (e.g., the filter end) of the cigarette.

Certain types of cigarettes that employ carbonaceous fuel elements have been commercially marketed under the brand names "Premier" and "Eclipse" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000). More recently, a cigarette has been marketed in Japan by Japan Tobacco Inc. under the brand name "Steam Hot One.: It has also been suggested that the carbonaceous fuel elements of segmented types of cigarettes may incorporate ultrafine particles of metals and metal oxides. See, for example, U.S. Pat. App. Pub. No. 2005/0274390 to Banerjee et al., which is incorporated by reference herein in its entirety.

Yet other types of smoking articles, such as those types of smoking articles that generate flavored vapors by subjecting tobacco or processed tobaccos to heat produced from chemical or electrical heat sources are described in U.S. Pat. No. 5,285,798 to Banerjee et al. and U.S. Pat. No. 7,290,549 to Banerjee et al., and U.S. Pat. App. Pub. No. 2008/0092912 to Robinson et al., which are incorporated by reference herein in their entirety. One type of smoking article that has employed electrical energy to produce heat has been commercially marketed by Philip Morris Inc. under the brand name "Accord."

Smoking articles that employ sources of heat other than tobacco cut filler to produce tobacco-flavored vapors or tobacco-flavored visible aerosols have not received widespread commercial success. However, it would be highly desirable to provide smoking articles that demonstrate the ability to provide to a smoker many of the benefits and advantages of conventional cigarette smoking, without delivering considerable quantities of incomplete combustion and pyrolysis products.

SUMMARY

Embodiments of the present invention relate to smoking articles, and in particular, to rod-shaped smoking articles, such as cigarettes. A smoking article includes a lighting end (i.e., an upstream end) and a mouth end (i.e., a downstream end). The smoking article also includes an aerosol-generation system that includes (i) a heat generation segment, and (ii) an aerosol-generating region or segment located downstream from the heat generation segment. The smoking article may be configured in a variety of ways, including various insulative configurations related to the heat generation segment that may include one or more of glass or non-glass fiber materials that may or may not be woven, foamed monolithic material selected from metal, ceramic, and ceramic-metal composite (e.g., cermet), or other materials, which materials may also be incorporated in a buffer region between the heat generation and aerosol-generation segments.

Further features and advantages of the present invention are set forth in more detail in the following description.

BRIEF DESCRIPTION OF THE DRAWINGS

Embodiments may better be understood with reference to the following drawings, which are illustrative only and are not limiting.

DETAILED DESCRIPTION OF THE PREFERRED EMBODIMENTS

Aspects and embodiments of the present invention relating to various smoking articles, the arrangement of various components thereof, and the manner that those smoking articles incorporate overwrap components, are illustrated with reference to FIGS. 1 and 2. Like components are given like numeric designations throughout the figures. For the various figures, the thicknesses of the various wrapping materials and overwraps of the various smoking articles and smoking article components are exaggerated. Most preferably, wrapping materials and overwrap components are tightly wrapped around the smoking articles and smoking article components to provide a tight fit, and provide an aesthetically pleasing appearance. Exemplary smoking article construction may include features such as fibrous filter elements, foamed ceramic monoliths formed as insulators or fuel elements, and other features disclosed in U.S. patent application Ser. No. 12/546,107 to Sebastian, et al., filed Aug. 24, 2009, which is incorporated herein by reference in its entirety.

Figure 1:
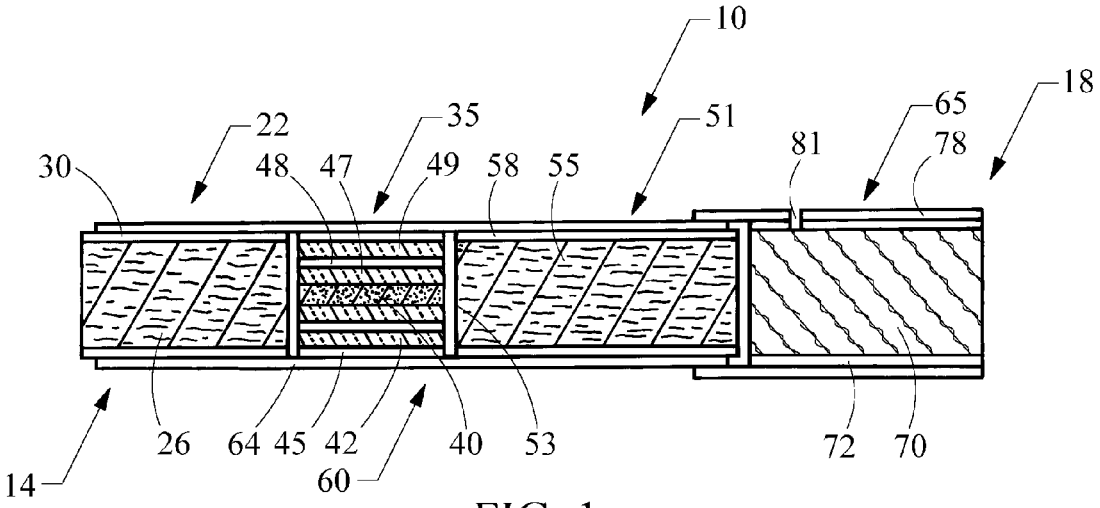
FIG. 1 and FIG. 2 provide longitudinal cross-sectional views of representative smoking articles.

Referring to FIG. 1, a representative smoking article 10 in the form of a cigarette is shown. The smoking article 10 has a rod-like shape, and includes a lighting end 14 and a mouth end 18.

At the lighting end 14 is positioned a longitudinally extending, generally cylindrical smokable lighting end segment 22, incorporating smokable material 26. A representative smokable material 26 can be a plant-derived material (e.g., tobacco material in cut filler form). An exemplary cylindrical smokable lighting end segment 22 includes a charge or roll of the smokable material 26 (e.g., tobacco cut filler) wrapped or disposed within, and circumscribed by, a paper wrapping material 30. As such, the longitudinally extending outer surface of that cylindrical smokable lighting end segment 22 is provided by the wrapping material 30. Preferably, both ends of the segment 22 are open to expose the smokable material 26. The smokable lighting end segment 22 can be configured so that smokable material 26 and wrapping material 30 each extend along the entire length thereof.

Located downstream from the smokable lighting end segment 22 is a longitudinally extending, generally cylindrical heat generation segment 35. The heat generation segment 35 includes a heat source 40 circumscribed by insulation 42, which may be coaxially encircled by wrapping material 45. The heat source 40 preferably is configured to be activated by combustion of the smokable material 26. Ignition and combustion of the smoking material preferably provide a user with a desirable experience (with respect at least to flavor and time taken to light the smoking article 10). The heat generated as the smokable material is consumed most preferably is sufficient to ignite or otherwise activate the heat source 40.

The heat source 40 may include a combustible fuel element that has a generally cylindrical shape and can incorporate a combustible carbonaceous material. Carbonaceous materials generally have high carbon contents. Preferred carbonaceous materials are composed predominately of carbon, typically have carbon contents of greater than about 60 percent, generally greater than about 70 percent, often greater than about 80 percent, and frequently greater than about 90 percent, on a dry weight basis. Fuel elements can incorporate components other than combustible carbonaceous materials (e.g., tobacco components, such as powdered tobaccos or tobacco extracts; flavoring agents; salts, such as sodium chloride, potassium chloride and sodium carbonate; heat stable graphite fibers; iron oxide powder; glass filaments; powdered calcium carbonate; alumina granules; ammonia sources, such as ammonia salts; and/or binding agents, such as guar gum, ammonium alginate and sodium alginate). A representative fuel element has a length of about 12 mm and an overall outside diameter of about 4.2 mm. A representative fuel element can be extruded or compounded using a ground or powdered carbonaceous material, and has a density that is greater than about 0.5 g/cm$^3$, often greater than about 0.7 g/cm$^3$, and frequently greater than about 1 g/cm$^3$, on a dry weight basis. See, for example, the types of fuel element components, formulations and designs set forth in U.S. Pat. No. 5,551,451 to Riggs et al. and U.S. Pat. App. Pub. No. 2009/0090373 to Borschke et al., which are incorporated herein by reference in their entirety. Particular embodiments of fuel elements are described below with reference to FIG. 3.

Another embodiment of a fuel element 40 may include a foamed carbon monolith formed in a foam process. In another embodiment, the fuel element 40 may be co-extruded with a layer of insulation 42, thereby reducing manufacturing time and expense. Still other embodiments of fuel elements may include those of the types described in U.S. Pat. No. 4,922,901 to Brooks et al. or U.S. Pat. App. Pub. No. 2009/0044818 to Takeuchi et al., each of which is incorporated herein by reference.

A representative layer of insulation 42 can comprise glass filaments or fibers. The insulation 42 can act as a jacket that assists in maintaining the heat source 40 firmly in place within the smoking article 10. The insulation 42 can be provided as a multi-layer component including an inner layer or mat 47 of non-woven glass filaments, an intermediate layer of reconstituted tobacco paper 48, and an outer layer of non-woven glass filaments 49. These may be concentrically oriented or each overwrapping and/or circumscribing the heat source.

In one embodiment, the inner layer 47 of insulation may include a variety of glass or non-glass filaments or fibers that are woven, knit, or both woven and knit (such as, for example, so-called 3-D woven/knit hybrid mats). When woven, an inner layer 47 may be formed as a woven mat or tube. A woven or knitted mat or tube can provide superior control of air flow with regard to evenness across the insulation layer, including as any thermal-related changes may occur to the layer). Those of skill in the art will appreciate that a woven, knit, or hybrid material may provide more regular and consistent air spaces/gaps between the filaments or fibers as compared to a non-woven material which is more likely to have irregularly closed and open spaces that may provide comparatively non-uniform and/or decreased air-flow. Various other insulation embodiments may be molded, extruded, foamed, or otherwise formed. Particular embodiments of insulation structures are described below with reference to FIGS. 4A-4G.

Preferably, both ends of the heat generation segment 35 are open to expose the heat source 40 and insulation 42 to the adjacent segments. The heat source 40 and the surrounding insulation 42 can be configured so that the length of both materials is co-extensive (i.e., the ends of the insulation 42 are flush with the respective ends of the heat source 40, and particularly at the downstream end of the heat generation segment). Optionally, though not necessarily preferably, the insulation 42 may extend slightly beyond (e.g., from about 0.5 mm to about 2 mm beyond) either or both ends of the heat source 40. Moreover, smoke produced when the smokable lighting end segment 22 is burned during use of the smoking article 10 can readily pass through the heat generation segment 35 during draw by the smoker on the mouth end 18.

The heat generation segment 35 preferably is positioned adjacent to the downstream end of the smokable lighting end segment 22 such that those segments are axially aligned in an end-to-end relationship, preferably abutting one another, but with no barrier (other than open air-space) therebetween. The close proximity of the heat generation segment 35 and the smokable lighting end segment 22 provides for an appropriate heat exchange relationship (e.g., such that the action of burning smokable material within the smokable lighting end segment 22 acts to ignite the heat source of the heat generation segment 35). The outer cross-sectional shapes and dimensions of the smokable lighting end and heat generation segments 22, 35, when viewed transversely to the longitudinal axis of the smoking article, can be essentially identical to one another (e.g., both appear to have a cylindrical shape, each having essentially identical diameters).

The cross-sectional shape and dimensions of the heat generation segment 35, prior to burning, can vary. Preferably, the cross-sectional area of the heat source 40 makes up about 10 percent to about 35 percent, often about 15 percent to about 25 percent of the total cross-sectional area of that segment 35; while the cross-sectional area of the outer or circumscribing region (comprising the insulation 42 and relevant outer wrapping materials) makes up about 65 percent to about 90 percent, often about 75 percent to about 85 percent of the total cross-sectional area of that segment 35. For example, for a cylindrical smoking article having a circumference of about 24 mm to about 26 mm, a representative heat source 40 has a generally circular cross-sectional shape with an outer diameter of about 2.5 mm to about 5 mm, often about 3 mm to about 4.5 mm.

A longitudinally extending, cylindrical aerosol-generating segment 51 is located downstream from the heat generation segment 35. The aerosol-generating segment 51 includes a substrate material 55 that, in turn, acts as a carrier for an aerosol-forming agent or material (not shown). For example, the aerosol-generating segment 51 can include a reconstituted tobacco material that includes processing aids, flavoring agents and glycerin.

The foregoing components of the aerosol-generating segment 51 can be disposed within, and circumscribed by, a wrapping material 58. A wrapping material 58 can be configured to facilitate the transfer of heat from the lighting end 14 of the smoking article 10 (e.g., from the heat generation segment 35) to components of the aerosol-generating segment 51. That is, the aerosol-generating segment 51 and the heat generation segment 35 can be configured in a heat exchange relationship with one another. The heat exchange relationship is such that sufficient heat from the heat source 40 is supplied to the aerosol-formation region to volatilize aerosol-forming material for aerosol formation. In some embodiments, the heat exchange relationship is achieved by positioning those segments in close proximity to one another. A heat exchange relationship also can be achieved by extending a heat conductive material from the vicinity of the heat source 40 into or around the region occupied by the aerosol-generating segment 51. Particular embodiments of substrates are described below with reference to FIG. 5.

A representative wrapping material 58 for the substrate material 55 may include heat conductive properties to conduct heat from the heat generation segment 35 to the aerosol-generating segment 51, in order to provide for the volatilization of the aerosol forming components contained therein. The substrate material 55 may be about 10 mm to about 22 mm in length, with certain embodiments being about 11 mm to about 12 mm in length, and other embodiments ranging up to about 21 mm.

The substrate material 55 can be provided from a blend of flavorful and aromatic tobaccos in cut filler form. Those tobaccos, in turn, can be treated with aerosol-forming material and/or at least one flavoring agent. The substrate material can be provided from a processed tobacco (e.g., a reconstituted tobacco manufactured using cast sheet or papermaking types of processes) in cut filler form. That tobacco, in turn, can be treated with, or processed to incorporate, aerosol-forming material and/or at least one flavoring agent, as well as a burn retardant (e.g., diammonium phosphate or another salt) configured to help prevent ignition and/or scorching by the heat-generation segment. A metal inner surface of the wrapping material 58 of the aerosol-generating segment 51 can act as a carrier for aerosol-forming material and/or at least one flavoring agent.

In other embodiments, the substrate 55 may include a tobacco paper or non-tobacco gathered paper formed as a plug section. The plug section may be loaded with aerosol-forming materials, flavorants, tobacco extracts, or the like in a variety of forms (e.g., microencapsulated, liquid, powdered). A burn retardant (e.g., diammonium phosphate or another salt) may be applied to at least a distal/lighting-end portion of the substrate to help prevent ignition and/or scorching by the heat-generation segment.

In these and/or other embodiments, the substrate 55 may include marumarized tobacco that has been formed into pellets or beads. Marumarized tobacco is known, for example, from U.S. Pat. No. 5,105,831 to Banerjee, et al., which is incorporated herein by reference. Marumarized tobacco may include about 20 to about 50 percent (by weight) tobacco blend in powder form, with glycerol (at about 20 to about 30 percent by weight), calcium carbonate (at about 40 to about 60 percent by weight), along with binder and flavoring agents. The beads, pellets, or other marumarized forms may be constructed in dimensions appropriate to fitting within a substrate section and providing for optimal air flow and production of desirable aerosol.

Figure 2:
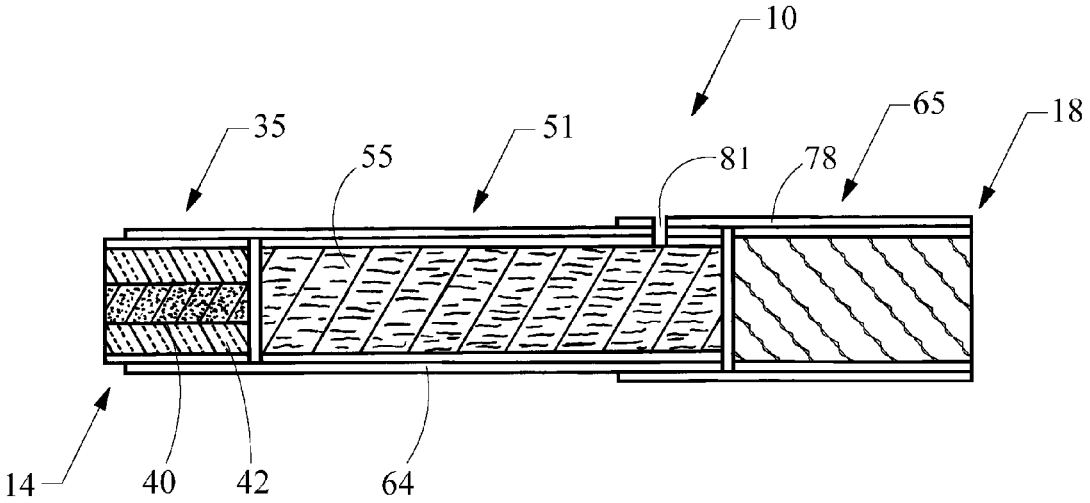

In these or other embodiments, the substrate 55 may include an open interior section 66 (as shown in FIG. 2). This open region may allow for aerosol condensation and improved transport/aerosolization of vaporizable materials being released by heat during use of the smoking article. The surface of the interior opening 66 may be coated or otherwise treated with flavorants, tobacco extracts, or other materials to provide desirable flavors and/or organoleptic properties to the aerosol traveling therethrough.

For preferred smoking articles, both ends of the aerosol-generating segment 51 are open to expose the substrate material 55 thereof. Components of the aerosol produced by burning the smokable lighting end segment 22 during use of the smoking article can readily pass through the aerosol-generating segment 51 during draw on the mouth end 18.

Together, the heat generating segment 35 and the aerosol-generating segment 51 form an aerosol-generation system 60. The aerosol-generating segment 51 is positioned adjacent to the downstream end of the heat generation segment 35 such that those segments 51, 35 are axially aligned in an end-to-end relationship. Those segments can abut one another, or be positioned in a slightly spaced apart relationship, which may include a buffer region 53. The outer cross-sectional shapes and dimensions of those segments, when viewed transversely to the longitudinal axis of the smoking article 10, can be essentially identical to one another. The physical arrangement of those components preferably is such that heat is transferred (e.g., by means that includes conductive and convective heat transfer) from the heat source 40 to the adjacent substrate material 55, throughout the time that the heat source is activated (e.g., burned) during use of the smoking article 10.

A buffer region 53 may reduce potential scorching or other thermal degradation of portions of the aerosol-generating segment 51. The buffer region 53 may mainly include empty air space, or it may be partially or substantially completely filled with a non-combustible material such as, for example, metal, organic, inorganic, ceramic, or polymeric materials, or any combination thereof. The buffer regions may be from about 1 mm to about 10 mm or more in thickness, but often will be about 2 mm to about 5 mm in thickness.

The components of the aerosol-generation system 60 and the smokable lighting end segment 22 preferably are attached to one another, and secured in place using an overwrap material 64. For example, the overwrap material 64 can include a paper wrapping material or a laminated paper-type material that circumscribes each of the heat generation segment 35, at least a portion of outer longitudinally extending surface of the aerosol-generating segment 51, and at least a portion of an the lighting end segment 22 that is adjacent to the heat generation segment. The inner surface of the overwrap material 64 may be secured to the outer surfaces of the components it circumscribes by a suitable adhesive. Preferably, the overwrap material 64 extends over a significant portion of the length of the smokable lighting end segment 22.

The smoking article 10 preferably includes a suitable mouthpiece such as, for example, a filter element 65, positioned at the mouth end 18 thereof. The filter element 65 preferably is positioned at one end of the cigarette rod adjacent to one end of the aerosol-generating segment 51, such that the filter element 65 and the aerosol-generating segment 51 are axially aligned in an end-to-end relationship, abutting one another but without any barrier therebetween. Preferably, the general cross-sectional shapes and dimensions of those segments 51, 65 are essentially identical to one another when viewed transversely to the longitudinal axis of the smoking article. The filter element 65 may include filter material 70 that is overwrapped along the longitudinally extending surface thereof with circumscribing plug wrap material 72. In one example, the filter material 70 includes plasticized cellulose acetate tow, while in some examples the filter material may further include activated charcoal in an amount from about 20 to about 80 mg disposed as a discrete charge or dispersed throughout the acetate tow in a "Dalmatian type" filter. Both ends of the filter element 65 preferably are open to permit the passage of aerosol therethrough. The aerosol-generating system 60 preferably is attached to filter element 65 using tipping material 78. The filter element 65 may also include a crushable flavor capsule 76 of the type described in U.S. Pat. No. 7,479,098 to Thomas et al. and U.S. Pat. App. Pub. Nos. 2006/0272663 to Dube et al.; and 2009/0194118 to Ademe et al., which are incorporated herein by reference in their entirety.

The smoking article 10 may include an air dilution means, such as a series of perforations 81, each of which may extend through the filter element tipping material 78 and plug wrap material 72 in the manner shown, and/or which may extend to or into the substrate 55.

The overall dimensions of the smoking article 10, prior to burning, can vary. Typically, smoking articles 10 are cylindrically shaped rods having circumferences of about 20 mm to about 27 mm, have overall lengths of about 70 mm to about 130 mm—often about 83 mm to about 100 mm. Smokable lighting end segments 22 typically have lengths of about 3 mm to about 15 mm, but can be up to about 30 mm. The aerosol-generation system 60 has an overall length that can vary from about 20 mm to about 65 mm. The heat generation segment 35 of the aerosol-generation system 60 may have a length of about 5 mm to about 30 mm; and the aerosol-generating segment 51 of the aerosol-generation system 60 may have an overall length of about 10 mm to about 60 mm.

The amount of smokable material 26 employed to manufacture the smokable lighting end segment 22 can vary. Typically, the smokable lighting end segment 22, manufactured predominantly from tobacco cut filler, includes at least about 20 mg, generally at least about 50 mg, often at least about 75 mg, and frequently at least 100 mg, of tobacco material, on a dry weight basis. The packing density of the smokable material 26 within the smokable lighting end segment 22 preferably is less than the density of the fuel element (e.g., about 100 to about 400 mg/cm$^3$). Preferably, the smokable lighting end segment 22 essentially comprises smokable material 26, and does not include a carbonaceous fuel element component.

The combined amount of aerosol-forming agent and substrate material 55 employed in the aerosol-generating segment 51 can vary. The material preferably may be employed so as to fill the appropriate section of the aerosol-generating segment 51 (e.g., the region within the wrapping material 58 thereof) at a packing density of about 100 to about 400 mg/cm$^3$.

During use, the smoker lights the lighting end 14 of the smoking article 10 using a match or cigarette lighter, in a manner similar to the way that conventional smoking articles are lit. As such, the smokable material 26 of the smokable lighting end segment 22 begins to burn. The mouth end 18 of the smoking article 10 is placed in the lips of the smoker. Thermal decomposition products (e.g., components of tobacco smoke) generated by the burning smokable material 26 are drawn through the smoking article 10, through the filter element 65, and into the mouth of the smoker. That is, when smoked, the smoking article yields visible mainstream aerosol that resembles the mainstream tobacco smoke of traditional cigarettes that burn tobacco cut filler.

Burning the smokable lighting end segment 22 heats the fuel element 40 of the heat generation segment 35 such that it preferably will be ignited or otherwise activated (e.g., begin to burn). The heat source 40 within the aerosol-generation system 60 will burn, and provide heat to volatilize aerosol-forming material within the aerosol-generating segment 51 as a result of the heat exchange relationship between those two segments. Certain preferred heat sources 40 will not experience volumetric decrease during activation, while others may degrade in a manner that reduces their volume. Preferably, the components of the aerosol-generating segment 51 do not experience thermal decomposition (e.g., charring or burning) to any significant degree. Volatilized components are entrained in the air that is drawn through the aerosol-generating region 51. The aerosol so formed will be drawn through the filter element 65, and into the mouth of the smoker.

During certain periods of use, aerosol formed within the aerosol-generating segment 51, along with the aerosol (i.e., smoke) formed as a result of the thermal degradation of the smokable material 26 within the smokable lighting end segment 22, will be drawn through the filter element 65 and into the mouth of the smoker, along with the aerosol (i.e., smoke) formed as a result of the thermal degradation of the smokable material 26 within the smokable lighting end segment 22. Thus, the mainstream aerosol produced by the smoking article 10 includes tobacco smoke produced by the thermal decomposition of the tobacco cut filler as well as by the volatilized aerosol-forming material. For early puffs (i.e., during and shortly after lighting), most of the mainstream aerosol results from thermal decomposition of the smokable lighting end segment 22. For later puffs (i.e., after the smokable lighting end segment 22 has been consumed and the heat source 40 of the aerosol-generation system 60 has been ignited), most of the mainstream aerosol that is provided will be produced by the aerosol-generation system 60. When the smokable material 26 has been consumed, and the heat source 40 extinguishes, the use of the smoking article is ceased (i.e., the smoking experience is finished).

Referring to FIG. 2, a representative smoking article 10 in the form of a cigarette is shown. The smoking article 10 includes a heat generation segment 35 located at the lighting end 14, a filter segment 65 located at the other end (mouth end 18), and an aerosol-generating segment 51 (which may incorporate tobacco) that is located in between those two segments near the lighting end. The heat generation segment 35 of FIG. 2 can incorporate a generally cylindrical carbonaceous heat source circumscribed by insulation similar to what is shown in FIG. 1. The composition and dimensions of the various segments of the smoking article 10 in FIG. 2 are generally similar in manner with respect to those set forth previously with reference to FIG. 1, but without a charge of smokable material at the distal/lighting end, such that the fuel element is ignited directly rather than by a smokable material that was ignited and burned.

A filter element 65 preferably is attached to the cigarette rod so formed using a tipping material 78, in the general manner set forth previously with reference to FIG. 1. The smoking article optionally can be air-diluted by providing appropriate perforations 81 in the vicinity of the mouth end region 18, as is known in the art. Filters may include materials and may be manufactured by methods such as, for example, those disclosed in U.S. Pat. Publ. Nos. 2008/0029118 to Nelson et al.; 2008/0142028 to Fagg, et al.; 2008/0302373 to Stokes et al.; 2009/028867 to Hutchens et al.; and 2009/009037 to Thomas et al., each of which is incorporated herein by reference.

Flavor may be provided or enhanced by capsule or microcapsule materials on or within the substrate material 55 of the aerosol-generating segment 51 (FIG. 1 may be considered to have microcapsules present therein for illustrative purposes), the wrapping materials, the filter element 65, or any other component capable of holding and releasing flavorants, preferably with minimal thermal degradation that would undesirably alter the flavor. Other flavor components associated with a filter may also be used; see, for example, U.S. Pat. No. 5,724,997 to Fagg, et al.

Cigarettes described with reference to FIG. 2 may be used in much the same manner as those cigarettes commercially marketed under the trade name "Eclipse" by R. J. Reynolds Tobacco Company. See also the "Steam Hot One" cigarette marketed by Japan Tobacco Inc.

Smokable materials of the smokable lighting end segment most preferably incorporate tobacco of some form. Preferred smokable materials are composed predominantly of tobacco, based on the dry weights of those materials. That is, the majority of the dry weight of those materials, and the majority of the weight of a mixture incorporating those materials (including a blend of materials, or materials having additives applied thereto or otherwise incorporated therein) are provided by tobacco of some form. Those materials may be made all of tobacco material, and not incorporate any non-tobacco fillers, substitutes or extenders. The smokable material can be treated with tobacco additives that are traditionally used for the manufacture of cigarettes, such as casing and/or top dressing components. These tobacco components may be understood with reference to the examples and references set forth in U.S. Pat. App. Pub. No. 2007/0215167 to Crooks, et al., which is incorporated herein by reference in its entirety.

Fuel elements of the heat generation segment may vary. Suitable fuel elements, and representative components, designs and configurations thereof, and manners and methods for producing those fuel elements and the components thereof, are set forth in U.S. Pat. No. 4,714,082 to Banerjee et al.; U.S. Pat. No. 4,756,318 to Clearman et al.; U.S. Pat. No. 4,881,556 to Clearman et al.; U.S. Pat. No. 4,989,619 to Clearman et al.; U.S. Pat. No. 5,020,548 to Farrier et al.; U.S. Pat. No. 5,027,837 to Clearman et al.; U.S. Pat. No. 5,067,499 to Banerjee et al.; U.S. Pat. No. 5,076,297 to Farrier et al.; U.S. Pat. No. 5,099,861 to Clearman et al.; U.S. Pat. No. 5,105,831 to Banerjee et al.; U.S. Pat. No. 5,129,409 to White et al.; U.S. Pat. No. 5,148,821 to Best et al.; U.S. Pat. No. 5,156,170 to Clearman et al.; U.S. Pat. No. 5,178,167 to Riggs et al.; U.S. Pat. No. 5,211,684 to Shannon et al.; U.S. Pat. No. 5,247,947 to Clearman et al.; U.S. Pat. No. 5,345,955 to Clearman et al.; U.S. Pat. No. 5,469,871 to Barnes et al.; U.S. Pat. No. 5,551,451 to Riggs; U.S. Pat. No. 5,560,376 to Meiring et al.; U.S. Pat. No. 5,706,834 to Meiring et al.; and U.S. Pat. No. 5,727,571 to Meiring et al.; and U.S. Pat. App. Pub. Nos. 2005/0274390 and 2010/0065075 to Banerjee et al.; which are incorporated herein by reference.

Fuel elements often comprise carbonaceous material and may include ingredients such as graphite or alumina, as well as high carbon content carbonaceous material. Carbonaceous fuel elements include the type that have been incorporated within those cigarettes commercially marketed under the trade names "Premier" and "Eclipse" by R. J. Reynolds Tobacco Company. See also the "Steam Hot One" cigarette marketed by Japan Tobacco Inc. Some other embodiments of fuel elements are set forth in U.S. Pat. No. 5,178,167 to Riggs et al. and U.S. Pat. No. 5,551,451 to Riggs et al., both which are incorporated herein by reference in their entirety, but certain embodiments may lack the sodium, graphite, and/or calcium carbonate set forth therein. Some fuel element embodiments may include a foamed carbon monolith. In another embodiment, the fuel element 40 may be co-extruded with a layer of insulation 42, thereby reducing manufacturing time and expense.

Figure 3:
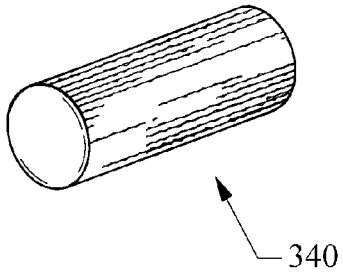
FIG. 3 shows a representative fuel element.

FIG. 3 shows an example of a carbonaceous fuel element 340 of the type disclosed above with reference to heat source 40. The following exemplary embodiments are described with reference thereto, but may be applied to fuel elements having different geometries and/or underlying compositions.

In a first embodiment, a fuel element 340 may be dip-coated with a mixture of two or more precursors. For example, copper nitrate hemi pentahydrate (available from Alfa Aesar) is mixed with equal weight of cerium nitrate hexahydrate (available from Alfa Aesar). The mixture of nitrates may then be dissolved in water (50% w/w). The fuel element 340 will then be coated with this aqueous solution, and the coated fuels are dried overnight at about 110° C.

The treated fuel element 340 is subjected to a heat treatment under nitrogen in a programmable Barnstead THERMOLYNE 62700 furnace by being heated to about 400° C. at a ramp rate of about 5° C. per minute and held for about four hours. The minimum temperatures at which a complete conversion of cerium nitrate hexahydrate to ceria and conversion of copper nitrate hemi pentahydrate to copper oxide take place may be determined by thermo-gravimetric analysis (TGA) using Model STA409 PC analyzer from Netzsch Instruments, Inc. Both transitions typically take place at or below about 300° C.

The fuel element 340 may be equilibrated under ambient conditions and inserted into a cigarette 10 similar in construction to that shown in FIG. 1. A cigarette 10 thus prepared may be smoked under 50/30/2 smoking conditions (i.e., 50 ml puffs of 2 second duration separated by 28 seconds) and CO in the mainstream measured by nondispersive infrared spectroscopy (NDIR), for example, using an NGA 2000 from Rosemount Inc. Treatment of the fuel with a mixture of cerium nitrate hexahydrate and copper nitrate hemi pentahydrate followed by heat treatment of the fuel will result in about 68% reduction of mainstream CO as compared to a control treated only with water. Nicotine and tar yields of the cigarettes will not be significantly affected by this modified fuel element. This reduction of CO is believed to result from a synergistic effect in the catalytic activity of the two metal oxides. The ratio of copper nitrate hemi pentahydrate and cerium nitrate hexahydrate may be further optimized for maximum catalytic activity. In other preparations of similar embodiments, the fuel element 340 can be dip-coated with the hydrates in sequence or the hydrates can be applied together or in sequence to the finished product either drop wise or by dipping the fuel end of the finished product into the hydrate solution.

In another embodiment described with reference to making a fuel element such as, for example, a fuel element 340 shown in FIG. 3, two or more metal nitrates or other metal oxide precursors may be mixed and dissolved in water. The solution may then applied to graphite. The treated graphite may then be dried and calcined to yield metal-oxide coated graphite. Proper selection of metal oxides and processing conditions will yield synergistic catalytic activity. In variant embodiments of this application, the precursor solutions can be added sequentially to graphite, i.e. one metal nitrate solution is added to the graphite, dried and calcined as described before to convert the metal nitrate to metal oxide. The resulting metal oxide coated graphite may then be impregnated with a second metal oxide precursor solution followed by drying and calcination.

In yet another embodiment described with reference to making a fuel element such as, for example, a fuel element 340, about 7.5 grams of cerium (III) nitrate hexahydrate (available from Alfa Aesar) and about 7.5 grams of copper (II) nitrate hemi pentahydrate (available from Alfa Aesar) may be dissolved in about 7 ml of water. Next, about 18 grams of graphite powder (available Superior Graphite Inc.) may be impregnated with the metal nitrate solution and dried overnight in air. The treated graphite may then be calcined at about 300° C. for about one hour under a nitrogen atmosphere in, for example, a programmable Barnstead THERMOLYNE 62700 furnace, where the ramp rate may be set at about 5° C./minute. Calcination will lead to decomposition of both the metal nitrates to their respective metal oxides.

The metal oxide-coated graphite may then be ground in a pestle mortar and combined with about 72 grams of milled BKO carbon powder (available from Barnaby and Suttcliffe), and about 10 grams of guar gum. Further mixing may be done in, for example, a Sigma blade mixer (Teledyne) for about an hour at a low speed. Water may then be added to convert the powder into plastic dough by mixing for about two additional hours. Sufficient water preferably will be added to ensure that the plastic mix is stiff enough to hold its shape after extrusion. The moisture content of the dough at this stage will typically be about 42 to 43% (w/w). The dough preferably will be aged overnight in a sealed container at room temperature.

For extrusion, the plastic mix may be loaded into the barrel of a batch extruder. One end of the barrel preferably will be fitted with an extrusion die for shaping the extrudate. A female extrusion die may be provided with a tapered surface to facilitate smooth flow of the plastic mass. Such a die may have, for example, five or seven slots and be about 4.2 mm in diameter. An optional central steel pin may be used to provide a central passageway through the extrudate (e.g., as is shown in FIGS. 4B-4C, below). A die pressure of about 3000 lbs. may be used for extrusion. The wet extruded rods preferably are placed on a well-ventilated tray for approximately one hour, and may then be carefully cut into about 12 mm lengths while preferably preserving the shape of the extrudate and the integrity of the axial hole. The cut fuel rods 340 may then be dried overnight at about room temperature. A cigarette 10 constructed using this embodiment and smoked under 60/30/2 smoking conditions may provide mainstream aerosol having its CO reduced by about 56%, compared to a cigarette with an untreated control fuel element.

Addition of metal oxide precursor solution to graphite occasionally may result in agglomeration of the metal oxide on the graphite surface, leading to reduced catalytic activity. Such agglomeration is believed due to the relatively low surface area and hydrophobic nature of the graphite surface. Adding carbon to graphite before impregnation with precursor solution will minimize agglomeration of the metal oxide and result in a higher catalytic activity. In another embodiment, about 18 grams of graphite may be mixed with about 18 grams of milled BKO carbon. About 15 grams of copper nitrate hemi-penta-hydrate will be dissolved in about 7.5 ml of water. The mixture of graphite and carbon may then uniformly be impregnated with the copper nitrate solution and dried overnight at room temperature. The coated carbon-graphite mixture may thereafter be calcined at about 300° C. for one hour under a nitrogen atmosphere. Fuel elements may be extruded and cut as described earlier. Cigarettes made with this metal nitrate-treated, carbon-graphite mixture will produce about 50% less CO in the mainstream smoke than a control cigarette using an untreated fuel element.

Compared to graphite, BKO milled carbon has a large surface area and consequently has a large adsorption capacity for the metal oxide catalyst precursor solution. This results in a highly uniform dispersion of the solution with minimum agglomeration of the metal oxide and thus a good activity of the metal oxide catalyst.

In still another embodiment, about 7.5 grams of copper nitrate hemi pentahydrate may be dissolved in 7 grams of water. About 18 grams of BKO milled carbon is impregnated with the solution and the mixture is dried overnight at room temperature. The treated carbon is calcined at about 300° C. for one hour under nitrogen atmosphere. The calcined carbon is mixed with other fuel ingredients and is extruded into fuel rods as described before. A cigarette prepared with this fuel will have about a 50% reduction in mainstream CO compared to cigarettes produced with untreated fuel elements. In addition, cigarettes produced with the treated milled carbon fuel may be easier to light than cigarettes produced with fuel made with precursor-treated graphite described above.

The carbonaceous fuel elements commonly in use typically are extruded with a binder that is mostly organic in nature. Some commonly used binders include ammonium alginate, carboxymethyl cellulose, ethyl cellulose and guar gum. These binders provide good flow characteristics and improved physical and mechanical properties for processing the extrudate. However, upon combustion the extruded fuel may produce volatile organic compounds that negatively influence the taste, aroma, and chemistry of the smoke. These volatile organic compounds may nearly be eliminated if the extruded fuel is calcined prior to its use in the cigarette.

Accordingly, certain fuel embodiments may be extruded, having been formed using (by weight) about 30% calcium carbonate, about 10% guar gum, about 10% copper nitrate-treated graphite, and about 50% carbon. Treatment of graphite with catalyst precursor and the process of extrusion may be conducted as described above. The extruded fuel may be calcined at about 500° C. for about two hours under nitrogen atmosphere. In test cigarettes constructed with the calcined fuels no significant impact was observed on the yields of tar, nicotine and carbon monoxide of the cigarette but significant improvements were noted with regard to taste and aroma of the mainstream and side stream smoke.

The fuel element preferably will be circumscribed or otherwise jacketed by insulation, or other suitable material. The insulation can be configured and employed so as to support, maintain and retain the fuel element in place within the smoking article. The insulation may additionally be configured such that drawn air and aerosol can pass readily therethrough. Examples of insulation materials, components of insulation assemblies, configurations of representative insulation assemblies within heat generation segments, wrapping materials for insulation assemblies, and manners and methods for producing those components and assemblies, are set forth in U.S. Pat. No. 4,807,809 to Pryor et al.; U.S. Pat. No. 4,893,637 to Hancock et al.; U.S. Pat. No. 4,938,238 to Barnes et al.; U.S. Pat. No. 5,027,836 to Shannon et al.; U.S. Pat. No. 5,065,776 to Lawson et al.; U.S. Pat. No. 5,105,838 to White et al.; U.S. Pat. No. 5,119,837 to Banerjee et al.; U.S. Pat. No. 5,247,947 to Clearman et al.; U.S. Pat. No. 5,303,720 to Banerjee et al.; U.S. Pat. No. 5,345,955 to Clearman et al.; U.S. Pat. No. 5,396,911 to Casey, III et al.; U.S. Pat. No. 5,546,965 to White; U.S. Pat. No. 5,727,571 to Meiring et al.; U.S. Pat. No. 5,902,431 to Wilkinson et al.; and U.S. Pat. No. 5,944,025 to Cook et al.; which are incorporated herein by reference. Insulation assemblies have been incorporated within the types of cigarettes commercially marketed under the trade names "Premier" and "Eclipse" by R. J. Reynolds Tobacco Company, and as "Steam Hot One" cigarette marketed by Japan Tobacco Inc.

FIGS. 4A-4G show different embodiments of insulation and fuel elements of a heat generation segment. In certain embodiments, the insulation layer may include about 40 to about 50 percent (by weight) flue-cured tobacco lamina, about 20 to about 25 percent (by weight) water-soluble flue-cured tobacco stems extract, and about 20 to about 25 percent (by weight) wood pulp. In certain embodiments, the layer may include about 20 percent (by weight) carbon fiber, or about 20 percent (by weight) c-glass fiber. Preferred insulation layers thus formed include a treatment of about 5 to about 15 percent ammonium chloride ($NH_4Cl$), or of a 50/50 mixture of about 5 percent $NH_4Cl$ and 5 percent sodium bicarbonate, by which is meant that the compound(s) will be present on the insulation layer sheet(s). These and other flame-retardants may be used in varying amounts. The insulation thus formed may be manufactured on a standard fourdrinier paper-making machine. Preferred insulation layer sheets thus formed will include a porosity of about 50 to about 150 cfm, a basis weight of about 80 to about 150 gsm, and a tensile strength of about 2000 to about 3000 gsm.

An insulation layer 42 may include an inner-facing geometry configured to engage and longitudinally retain a heat source 40. The engagement may be accomplished by a compression fit, co-extrusion of heat-source and insulation materials, or other methods known or developed in the art. Preferred heat sources include those that experience little if any volumetric decrease during a smoking activity. Certain heat sources may degrade and shrink longitudinally and/or circumferentially after being ignited, but—for preferred embodiments incorporating complementarily-shaped insulation elements—heat source embodiments including a matrix or other composition that generally retains volume after ignition are preferable.

Figure 4A:
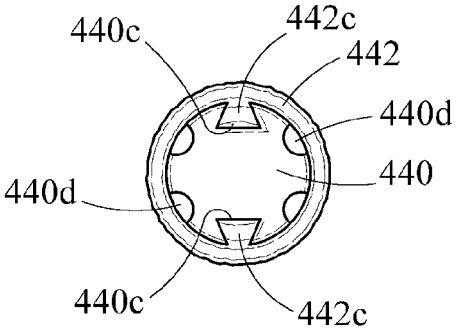
FIGS. 4A-4G show representative fuel element and insulation embodiments.
Figure 4B:
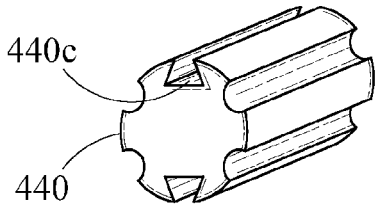
Figure 4C:
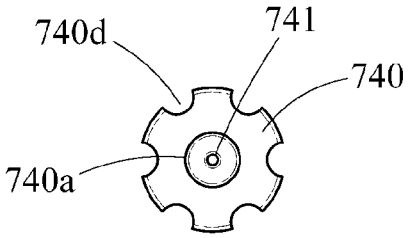

FIGS. 4A-4B show, respectively, an end view of an insulation material 442 and heat source 440, and a perspective view of the heat source 440 without the insulation material 442. These elements are configured to interlockingly engage with a dovetail connection, where the inward-facing surface insulation material 442 includes an inward-facing geometry with a flared tongue protrusion 442*c* configured to engage in dovetail fashion with a complementarily-shaped flared groove 440*c* in an outward-facing recessed groove geometry of the heat source 440. The outward-facing geometry of the heat source 440 includes generally elongate rounded grooves 440*d* configured to facilitate airflow. In one embodiment, the dovetail groove 440*c* will be only one-half as wide at its narrowest portion (at the top/edge of the outer heat source surface) as it is at the groove's widest portion. It should be appreciated that the flared tongue and groove may be constructed in variant fashion, by—for example—reversing the relative position of the dovetailed elements, orienting them other than longitudinally, and/or providing other interengaging tongue/groove geometries.

Figure 4D:
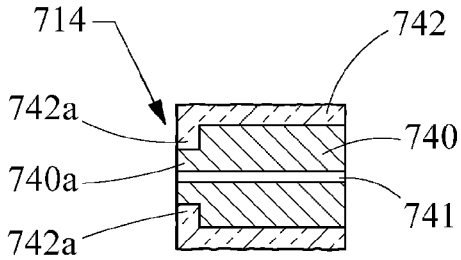

FIGS. 4C-4D show, respectively, an end view of a heat source 740, and a longitudinal section view of the heat source 740 with the insulation material 742. These elements are configured to interlockingly engage, with the insulation forming a retaining lip or shoulder 742*a* at the lighting end 714. That is, the inward-facing surface of the insulation material 742 includes an inward-facing geometry with a protrusion 742*a* configured to engage around a complementarily-shaped lighting end decreased-diameter cylindrical segment 740*a* of the heat source 740. The outward-facing geometry of the heat source 740 may include generally elongate rounded exterior grooves 740*d* that are configured to facilitate airflow. A heat source 740 may include one or more generally central longitudinal channels 741.

Figure 4E:
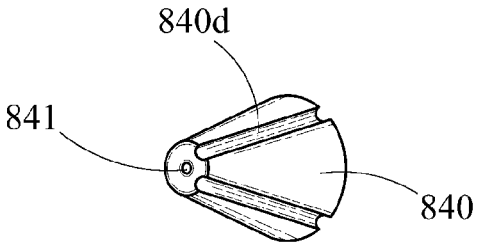
Figure 4F:
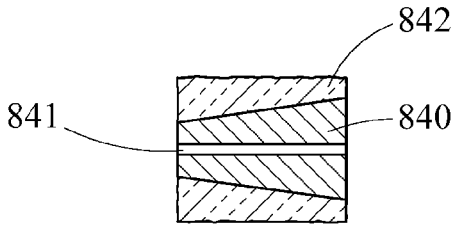

FIGS. 4E-4F show, respectively, a perspective view of a generally frustoconical heat source 840, and a longitudinal section view of the heat source 840 with an insulation material 842. These elements are configured to engage, with the inward-facing geometry of the insulation 842 forming a generally frustoconical space that houses and complementarily fits the heat source 840. The outward-facing geometry of the heat source 840 may include generally elongate rounded exterior grooves 840*d* that are configured to facilitate airflow. In many embodiments, five to eight such grooves may provide a desired airflow. This and other embodiments may include features described with reference only in various other embodiments herein. For example, a heat source 840 may include one or more generally central longitudinal channels 841.

Figure 4G:
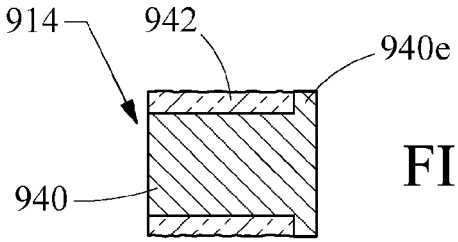

FIG. 4G shows a longitudinal section view of the heat source 940 with an insulation material 942. These elements are configured to engage, with the inward-facing geometry of the insulation 942 forming a generally columnar space that houses and complementarily fits the heat source 940. The heat source 940 includes a flared base 940*e* opposite the lighting end 914 that is configured to longitudinally retain it within the insulation 942.

In one specific example, an insulation material may be constructed including about 50 percent (by weight) flue-cured tobacco lamina, about 25 percent (by weight) water-soluble flue-cured tobacco stems extract, and about 25 percent (by weight) wood pulp. After being formed into a sheet, the material may be treated with about 5 to about 15 percent ammonium chloride ($NH_4Cl$), or of a 50/50 mixture of about 5 percent $NH_4Cl$ and 5 percent sodium bicarbonate. The insulation material may be manufactured as a sheet on a standard fourdrinier paper-making machine. The sheet insulation will include a porosity of about 50 to about 150 cfm, a basis weight of about 80 to about 150 gsm, and a tensile strength of about 2000 to about 3000 gsm.

In another example, an insulation material may be constructed including about 40 percent (by weight) flue-cured tobacco lamina, about 20 percent (by weight) water-soluble flue-cured tobacco stems extract, about 20 percent (by weight) wood pulp, and about 20 percent (by weight) c-glass fiber. After being formed into a sheet, the material may be treated with about 5 to about 15 percent ammonium chloride ($NH_4Cl$), or of a 50/50 mixture of about 5 percent $NH_4Cl$ and 5 percent sodium bicarbonate. The insulation material may be manufactured as a sheet on a standard fourdrinier paper-making machine. The sheet insulation will include a porosity of about 50 to about 150 cfm, a basis weight of about 80 to about 150 gsm, and a tensile strength of about 2000 to about 3000 gsm.

In still another example, an insulation material may be constructed including about 40 percent (by weight) flue-cured tobacco lamina, about 20 percent (by weight) water-soluble flue-cured tobacco stems extract, about 20 percent (by weight) wood pulp, and about 20 percent (by weight) carbon fiber. After being formed into a sheet, the material may be treated with about 5 to about 15 percent ammonium chloride ($NH_4Cl$), or of a 50/50 mixture of about 5 percent $NH_4Cl$ and 5 percent sodium bicarbonate. The insulation material may be manufactured as a sheet on a standard fourdrinier paper-making machine. The sheet insulation will include a porosity of about 50 to about 150 cfm, a basis weight of about 80 to about 150 gsm, and a tensile strength of about 2000 to about 3000 gsm.

Flame/burn retardant materials and additives useful in insulation may include silica, carbon, ceramic, metallic fibers and/or particles. When treating cellulosic or other fibers such as—for example—cotton, boric acid or various organophosphate compounds may provide desirable flame-retardant properties. In addition, various organic or metallic nanoparticles may confer a desired property of flame-retardancy, as may diammonium phosphate and/or other salts. Other useful materials may include organo-phosphorus compounds, borax, hydrated alumina, graphite, potassium tripolyphosphate, dipentaerythritol, pentaerythritol, and polyols. Others such as nitrogenous phosphonic acid salts, mono-ammonium phosphate, ammonium polyphosphate, ammonium bromide, ammonium chloride, ammonium borate, ethanolammonium borate, ammonium sulphamate, halogenated organic compounds, thio-urea, and antimony oxides may be used but are not preferred agents. In each embodiment of flame-retardant, burn-retardant, and/or scorch-retardant materials used in insulation, substrate material and other components (whether alone or in any combination with each other and/or other materials), the desirable properties most preferably are provided without undesirable off-gassing or melting-type behavior.

An insulation fabric made by any one of the above processes preferably will have sufficient oxygen diffusion capability to sustain a smoking article such as a cigarette lit during a desired usage time. Accordingly the insulation fabric preferably will be porous by virtue of its construction. In knit, woven, or combined woven and knit constructions, the required porosity may be controlled by configuring the assembly machinery to leave sufficient (desirably sized) gaps between fibers to allow for oxygen diffusion into the heat source. For non-woven fabrics, which may not be porous enough to promote evenly sustained combustion, additional porosity may be achieved by perforations into the insulation by methods known in the art including, for example, hot or cold pin perforation, flame perforation, embossing, laser cutting, drilling, blade cutting, chemical perforation, punching, and other methods. Each of the buffer and the insulation may include non-glass material that is woven, knit, or a combination thereof, a foamed metal material, a foamed ceramic material, a foamed ceramic metal composite, and any combination thereof, and the material in the insulation may be the same as or different than that in the buffer.

The aerosol-forming material can vary, and mixtures of various aerosol-forming materials can be used, as can various combinations and varieties of flavoring agents (including various materials that alter the sensory and/or organoleptic character or nature of mainstream aerosol of a smoking article), wrapping materials, mouth-end pieces, filter elements, plug wrap, and tipping material. Representative types of these components are set forth in U.S. Pat. App. Pub. No. 2007/0215167 to Crooks, et al., which is incorporated herein by reference in its entirety.

The substrate material can incorporate tobacco of some form, normally is composed predominantly of tobacco, and can be provided by virtually all tobacco material. The form of the substrate material can vary. In some embodiments, the substrate material is employed in an essentially traditional filler form (e.g., as cut filler). The substrate material can be otherwise formed into desired configurations. The substrate material can be used in the form of a gathered web or sheet, using the types of techniques generally set forth in U.S. Pat. No. 4,807,809 to Pryor et al, which is incorporated herein by reference in its entirety. The substrate material can be used in the form of a web or sheet that is shredded into a plurality of longitudinally extending strands, using the types of techniques generally set forth in U.S. Pat. No. 5,025,814 to Raker, which is incorporated herein by reference in its entirety. The substrate material can have the form of a loosely rolled sheet, such that a spiral type of air passageway extends longitudinally through the aerosol-generating segment. Representative types of tobacco containing substrate materials can be manufactured from mixtures of tobacco types; or from one predominant type of tobacco (e.g., a cast sheet-type or paper-type reconstituted tobacco composed primarily of burley tobacco, or a cast sheet-type or paper-type reconstituted tobacco composed primarily of Oriental tobacco).

The substrate material also can be treated with tobacco additives of the type that are traditionally used for the manufacture of cigarettes, such as casing and/or top dressing components. See, for example, the types of components set forth in U.S. Pat. Publication 2004/0173229 to Crooks et al, which is incorporated herein by reference in its entirety.

The manner by which the aerosol-forming material is contacted with the substrate material (e.g., the tobacco material) can vary. The aerosol-forming material can be applied to a formed tobacco material, or can be incorporated into processed tobacco materials during manufacture of those materials. The aerosol-forming material can be dissolved or dispersed in an aqueous liquid, or other suitable solvent or liquid carrier, and sprayed onto that substrate material. See, for example, U.S. Patent Application Pub. No. 2005/0066986 to Nestor et al, which is incorporated herein by reference in its entirety. The amount of aerosol-forming material employed relative to the dry weight of substrate material can vary. Materials including exceedingly high levels of aerosol-forming material can be difficult to process into cigarette rods using conventional types of automated cigarette manufacturing equipment.

Cast sheet types of materials may incorporate relatively high levels of aerosol-forming material. Reconstituted tobaccos manufactured using paper-making types of processes may incorporate moderate levels of aerosol-forming material. Tobacco strip and tobacco cut filler can incorporate lower amounts of aerosol-forming material. Various paper and non-paper substrates including gathered, laminated, laminated metal/metallic, strips, beads such as alumina beads, open cell foam, foamed monolith, air permeable matrices, and other materials can be used within the scope of the invention. See, for example, U.S. Pat. Nos. 5,183,062; 5,203,355; and 5,588,446; each to Clearman, and each of which is incorporated herein by reference.

Figure 5:
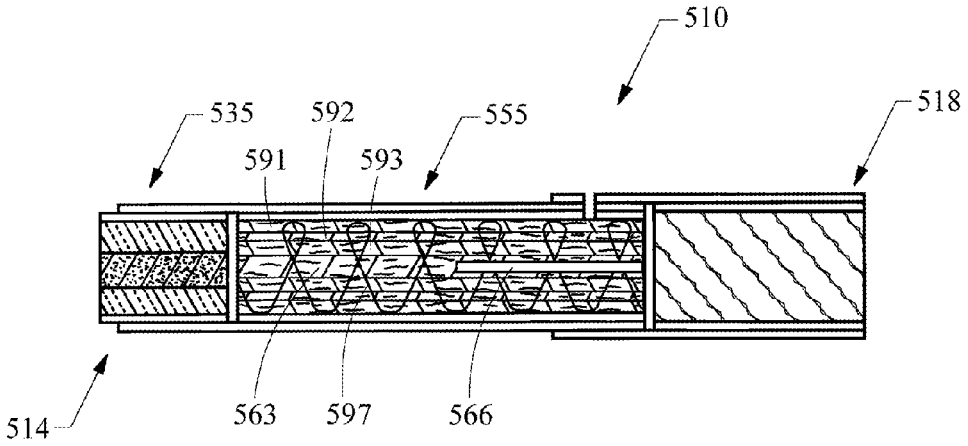
FIG. 5 shows another representative smoking article embodiment.

In one embodiment, the substrate may be constructed in a novel multilayer fashion not including cast sheet construction, discussed here with reference to FIG. 5, which is a longitudinal section view of a cigarette 510 having a lighting end 514 and a mouth end 518. The substrate 555 (which may be used in other embodiment such as, for example, those discussed with reference to FIG. 1 and FIG. 2) includes a multilayer construction that preferably is stitch-bonded together.

A generally cylindrical or other-shaped substrate core 563 may be centrally located in the substrate 555. The core 563 may include fabric (which may be treated with glycerin), and may also include an open longitudinal channel 566. A first outer layer 593 may be disposed coaxially around (i.e., generally encircling) the substrate core 563. The first outer layer 593 may be constructed including a fabric material such as, for example cotton or rayon. The fabric material preferably has been treated with glycerin such that the glycerin is absorbed into the fabric, which may also include one or more flame-retardant, burn-retardant, and or scorch-retardant agents. The first outer layer 593 may be constructed as a plurality of layers including a multilayer construction with two or more layers.

An intermediate layer 592 may be disposed generally coaxially/concentrically around the first outer layer 593. The intermediate layer 592 is constructed as a layer of aromatic tobacco paper 592. The tobacco paper may be treated with flavoring agents, including those known for use in treating cut tobacco, tobacco papers, and generally within the tobacco art, as well as agents that may yet be developed. Preferred flavoring agents will help provide a mainstream aerosol including desirable flavor and aroma. A second outer layer 591 may be disposed coaxially around the intermediate layer 592. Like the first outer layer 593, the second outer layer may be constructed as a plurality of layers including a multilayer construction with two or more layers. And, it may be constructed of fabric material that preferably has been treated with glycerin such that the glycerin is absorbed into the fabric, which may also include one or more flame-retardant, burn-retardant, and or scorch-retardant agents.

At least a portion of the first outer layer 593, second outer layer 591, and/or intermediate layer 592 preferably will be stitch-bonded together using a substrate heat-conducting material such as, for example, a metallic material (including as one example, aluminum). Stitch-bonding is known in the art of making non-woven fabrics (e.g., using barbed needles to entangle or otherwise bond fibers together to form a non-woven fabric or web). A stitch-bonding process may be used to form a three-layered substrate (e.g., as shown diagrammatically in FIG. 5) including at least one first outer layer 593, at least one intermediate layer 592, and at least one second outer layer 591 by joining one or more portions of two or more of the layers together. The heat-conducting material will help transmit heat from the heat-generation segment 535 in a matter configured to generate a desirable aroma and flavor from the substrate 555. This construction may be superior to cast sheet substrates, which may experience scorching and/or introduce undesirable flavors, tastes, aromas, etc. The presence of glycerin and the layered construction described with reference to the embodiment of FIG. 5 will help reduce scorching and minimize undesirable flavors and/or aromas associated with scorching. Embodiments with this and other substrate embodiments may be used with cigarettes including smokable material at the lighting end (e.g., as in FIG. 1).

Cigarettes of the present invention may be air-diluted or ventilated such that the amount of air dilution for an air diluted cigarette may be about 10 percent to about 80 percent. As used herein, the term "air dilution" is the ratio (expressed as a percentage) of the volume of air drawn through the air dilution means to the total volume of air and aerosol drawn through the cigarette and exiting the mouth end portion of the cigarette. Higher air dilution levels can act to reduce the transfer efficiency of aerosol-forming material into mainstream aerosol.

Preferred embodiments of cigarettes of the present invention, when smoked, yield an acceptable number of puffs. Such cigarettes normally provide more than about 6 puffs, and generally more than about 8 puffs, per cigarette, when machine-smoked under standardized smoking conditions. Such cigarettes normally provide less than about 15 puffs, and generally less than about 12 puffs, per cigarette, when smoked under standardized smoking conditions. Standardized smoking conditions consist of 35 ml puffs of 2 second duration separated by 58 seconds of smolder.

Aerosols that are produced by cigarettes of the present invention are those that comprise air-containing components such as vapors, gases, suspended particulates, and the like. Aerosol components can be generated from burning tobacco of some form (and optionally other components that are burned to generate heat); by thermally decomposing tobacco caused by heating tobacco and charring tobacco (or otherwise causing tobacco to undergo some form of smolder); and by vaporizing aerosol-forming agent. As such, the aerosol can contain volatilized components, combustion products (e.g., carbon dioxide and water), incomplete combustion products, and products of pyrolysis.

Aerosol components may also be generated by the action of heat from burning tobacco of some form (and optionally other components that are burned to generate heat), upon substances that are located in a heat exchange relationship with tobacco material that is burned and other components that are burned. Aerosol components may also be generated by the aerosol-generation system as a result of the action of the heat generation segment upon an aerosol-generating segment. In some embodiments, components of the aerosol-generating segment have an overall composition, and are positioned within the smoking article, such that those components will have a tendency not to undergo a significant degree of thermal decomposition (e.g., as a result of combustion, smoldering or pyrolysis) during conditions of normal use.

Drawings in the figures illustrating various embodiments are not necessarily to scale. Some drawings may have certain details magnified for emphasis, and any different numbers or proportions of parts should not be read as limiting, unless so-designated by one or more claims. Those of skill in the art will appreciate that embodiments not expressly illustrated herein may be practiced within the scope of the present invention, including that features described herein for different embodiments may be combined with each other and/or with currently-known or future-developed technologies while remaining within the scope of the claims presented here. It is therefore intended that the foregoing detailed description be regarded as illustrative rather than limiting. And, it should be understood that the following claims, including all equivalents, are intended to define the spirit and scope of this invention.

We claim:

1. A cigarette comprising:

a lighting end and a mouth end;

a mouth end piece segment disposed at the mouth end;

an aerosol-generation system disposed between the lighting end and the mouth end piece segment, the aerosol-generation system including a heat generation segment disposed at the lighting end having a length including a heat source configured to be activated by ignition of the lighting end and an insulation layer of flame-retardant material disposed around the heat source;

an aerosol-generating segment incorporating aerosol-forming material, said aerosol-generating segment having a length and being disposed between, but physically separate from, each of the heat generation segment and the mouth end, wherein the aerosol-generating segment includes a substrate comprising a central core comprising fabric throughout at least a portion of its cross-section, a first outer layer of a glycerin-treated fabric, coaxially disposed around the core, an intermediate layer coaxially disposed around the first outer layer, the intermediate layer including aromatic tobacco paper, and a second outer layer of a glycerin-treated fabric, coaxially disposed around the intermediate layer, wherein at least a portion of the first, intermediate, and second layers is stitch-bonded together with a substrate heat-conductive material; and a piece of outer wrapping material oriented to provide an overwrap (i) around the aerosol-generating segment for at least a portion of its length, and (ii) around the heat generation segment for the length of that segment, those segments being connected together by the overwrap to provide a cigarette rod; and the mouth end piece segment being connected to the cigarette rod using tipping material.

2. The cigarette of claim 1, wherein the substrate first outer layer comprises a plurality of layers.

3. The cigarette of claim 1, wherein the substrate second outer layer comprises a plurality of layers.

4. The cigarette of claim 1, wherein the heat generation segment and the aerosol-generating segment are disposed in a heat exchange relationship with one another and the insulation provides an insulative layer about at least a portion of the heat source.

5. The cigarette of claim 1, wherein the substrate heat-conductive material comprises aluminum.

6. The cigarette of claim 1, wherein at least one of the first outer layer and the second outer layer comprises rayon.

7. The cigarette of claim 1, wherein at least one of the first outer layer and the second outer layer comprises cotton.

8. The cigarette of claim 1, further comprising a buffer between the heat generation segment and the aerosol-generating segment.

9. The cigarette of claim 1, wherein the insulation layer further comprises c-glass fiber.

10. The cigarette of claim 1, wherein the insulation layer comprises a carbon fiber material.

11. The cigarette of claim 1, further comprising a smokable segment disposed at the lighting end, said smokable segment having a length and comprising a smokable material circumscribed by wrapping material.

12. The cigarette of claim 1, wherein the central core comprises an open space.

13. The cigarette of claim 1, wherein the heat source comprises a foamed structure comprising carbon.

14. A cigarette comprising:

a lighting end and a mouth end;

a smokable segment disposed at the lighting end, said smokable segment having a length and comprising a smokable material circumscribed by wrapping material;

an aerosol-generation system disposed between the lighting end and the mouth end, the aerosol-generation system including a heat generation segment adjacent to the smokable segment, said heat generation segment having a length and including a heat source configured to be activated by combustion of the smokable material and an insulation layer of flame-retardant material disposed around the heat source;

an aerosol-generating segment incorporating aerosol-forming material, said aerosol-generating segment having a length and being disposed between, but physically separate from, each of the heat generation segment and the mouth end, wherein the aerosol-generating segment includes a substrate comprising a central core comprising fabric throughout at least a portion of its cross-section, a first outer layer of a glycerin-treated fabric, coaxially disposed around the core, an intermediate layer coaxially disposed around the first outer layer, the intermediate layer including non-cast-sheet aromatic tobacco paper, and a second outer layer of a glycerin-treated fabric, coaxially disposed around the intermediate layer, wherein at least a portion of the first, intermediate, and second layers is stitch-bonded together with a metallic substrate heat-conductive material; and a piece of outer wrapping material oriented to provide an overwrap (i) around the aerosol-generating segment for at least a portion of its length, (ii) around the heat generation segment for the length of that segment, and (iii) around the smokable segment for at least a portion of its length; those segments being connected together by the overwrap to provide a cigarette rod; and a mouth end piece segment being connected to the cigarette rod using tipping material.

15. The cigarette of claim 14, wherein at least one of the substrate first outer layer and the second outer layer comprises a plurality of layers.

16. The cigarette of claim 14, wherein the heat generation segment and the aerosol-generating segment are disposed in a heat exchange relationship with one another and the insulation provides an insulative layer about at least a portion of the heat source.

17. The cigarette of claim 14, wherein the substrate heat-conductive material comprises aluminum.

18. The cigarette of claim 14, wherein at least one of the first outer layer and the second outer layer comprises rayon.

19. The cigarette of claim 14, wherein at least one of the first outer layer and the second outer layer comprises cotton.

20. A cigarette comprising:

a lighting end and a mouth end;

a smokable segment disposed at the lighting end, said smokable segment having a length and comprising a smokable material circumscribed by wrapping material;

an aerosol-generation system disposed between the lighting end and the mouth end, the aerosol-generation system including a heat generation segment adjacent to the smokable segment, said heat generation segment having a length and including a heat source configured to be activated by combustion of the smokable material and an insulation layer of flame-retardant material disposed around the heat source;

an aerosol-generating segment incorporating aerosol-forming material, said aerosol-generating segment having a length and being disposed between, but physically separate from, each of the heat generation segment and the mouth end, wherein the aerosol-generating segment includes a substrate comprising a central core comprising fabric throughout at least a portion of its cross-section, a first outer layer of a glycerin-treated fabric, coaxially disposed around the core, the first outer layer comprising a plurality of layers, an intermediate layer coaxially disposed around the first outer layer, the intermediate layer including non-cast-sheet aromatic tobacco paper, and a second outer layer of a glycerin-treated fabric, coaxially disposed around the intermediate layer, the second outer layer comprising a plurality of layers, wherein at least a portion of the first, intermediate, and second layers is stitch-bonded together with a metallic substrate heat-conductive material; and a piece of outer wrapping material oriented to provide an overwrap (i) around the aerosol-generating segment for at least a portion of its length, (ii) around the heat generation segment for the length of that segment, and (iii) around the smokable segment for at least a portion of its length; those segments being connected together by the overwrap to provide a cigarette rod; and a mouth end piece segment being connected to the cigarette rod using tipping material.

* * * * *